US005204687A

United States Patent [19]

Elliott et al.

[11] Patent Number: 5,204,687

[45] Date of Patent: Apr. 20, 1993

[54] ELECTRICAL DEVICE AND ELECTRICAL TRANSMITTER-RECEIVER PARTICULARLY USEFUL IN A CT2 CORDLESS TELEPHONE

[75] Inventors: Michael Elliott, Tiberias; Matti Martiskainen, Lower Galilee, both of Israel

[73] Assignee: Galtronics Ltd., Tiberias, Israel

[21] Appl. No.: 554,492

[22] Filed: Jul. 19, 1990

[51] Int. Cl.[5] ..... H01Q 1/24

[52] U.S. Cl. ..... 343/702; 343/895; 343/900

[58] Field of Search ..... 343/702, 900, 901, 895, 343/883, 880

[56] References Cited

U.S. PATENT DOCUMENTS

| | | | |
|---|---|---|---|
| 3,087,117 | 4/1963 | Mitchell | 343/702 |
| 4,095,229 | 6/1978 | Elliott | 343/715 |
| 4,121,218 | 10/1978 | Irwin et al. | 343/702 |
| 4,190,841 | 2/1980 | Harada | 343/903 |
| 4,598,295 | 7/1986 | Murphy | 343/702 |
| 4,725,845 | 2/1988 | Phillips | 343/702 |
| 4,860,024 | 8/1989 | Egashira | 343/702 |
| 4,862,182 | 8/1989 | Egashira | 343/702 |
| 4,890,114 | 12/1989 | Egashira | 343/702 |
| 4,958,382 | 9/1990 | Imanishi | 343/702 |

FOREIGN PATENT DOCUMENTS 0301175 2/1989 European Pat. Off. .

OTHER PUBLICATIONS

Patent Abstracts of Japan No. 13507 (E-485) Nov. 14, 1989 & JP-A-1204504 (Fujitsu).

Patent Abstracts of Japan No. 6215 (E-138) Oct. 28, 1982 & JP-A-57118403 (Zeneraru Research).

*Primary Examiner*—Rolf Hille

*Assistant Examiner*—Hoanganh Le

*Attorney, Agent, or Firm*—Benjamin J. Barish

[57] ABSTRACT

An electrical transmitter-receiver, particularly useful as a CT2 cordless telephone, includes a quarter wavelength antenna rod carried by the housing, and a quarter wavelength antenna coil carried by one end of the antenna rod. The antenna rod is movably mounted through an opening in its housing to a retracted position wherein substantially only the antenna coil is disposed externally of the housing, or to an extended position wherein substantially the complete antenna rod and the antenna coil are disposed externally of the housing. When the antenna rod is in its retracted position an electrical switch connects the antenna coil to the electrical circuit, and when the antenna rod is in its extended position an electrical switch connects the antenna rod to the electrical circuit.

20 Claims, 1 Drawing Sheet

ELECTRICAL DEVICE AND ELECTRICAL TRANSMITTER-RECEIVER PARTICULARLY USEFUL IN A CT2 CORDLESS TELEPHONE

FIELD AND BACKGROUND OF THE INVENTION

The present invention relates to electrical devices including an antenna assembly. The invention is particularly useful as an electrical transmitter-receiver receiver in a CT2 cordless telephone, and is therefore described below with respect to such application.

A new type of telephone concept is now being developed utilizing a CT2 cordless telephone to make calls not only at home or in the office, but also from public access points. Such public access points will be provided at various locations, called telepoints, enabling users located within a predetermined range, e.g., about 100 metres, of a telepoint to make a call. When making a call, the caller enters a personal identification number (PIN), which is checked by the system and within seconds, assuming everying is in order, the system will produce a dial tone to the caller enabling the caller to make a call in the normal way. According to the present concept of this system, a caller may make only outgoing calls from a telepoint.

OBJECTS AND BRIEF SUMMARY OF THE INVENTION

An object of the present invention is to provide an electrical device having a novel antenna assembly particularly useful as an electrical transmitter-receiver in the above-described CT2 cordless telephone system.

According to a broad aspect of the present invention, there is provided an electrical device comprising: a housing enclosing electrical circuitry of the electrical device; an antenna rod carried by the housing for use in long-range operation of the device and pretuned to a predetermined frequency; and an antenna coil carried by one end of the antenna rod for use in short-range operation of the device and pretuned to the same predetermined frequency. The antenna rod is movably mounted through an opening in the housing to a retracted position wherein substantially only the antenna coil is disposed externally of the housing, or to an extended position wherein substantially the complete antenna rod and the antenna coil are disposed externally of the housing. The electrical device further includes electrical switching means effective when the antenna rod is in its retracted position to connect the antenna coil to the electrical circuit and thereby to condition the device for short-range operation, and when the antenna rod is in its extended position to connect the antenna rod to the electrical circuit and thereby to condition the device for long-range operation.

According to a more specific aspect of the present invention, there is provided an electrical transmitter-receiver as described above but particularly useful in a CT2 cordless telephone, wherein the selectively enableable antenna coil and antenna rod are both of quarter wavelength.

The user may thus selectively condition the device, and particularly the antenna assembly, either for short range operation or longer range operation according to the particular location of the user with respect to the nearest telepoint. Thus, if the user is located relatively close to a telepoint, the antenna rod may be moved to its retracted position thereby enabling the antenna coil for operation, but if the user is at a relatively large distance from the telepoint, the antenna rod may be moved to its extended position thereby enabling the antenna rod and accordingly providing higher gain than the antenna coil.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
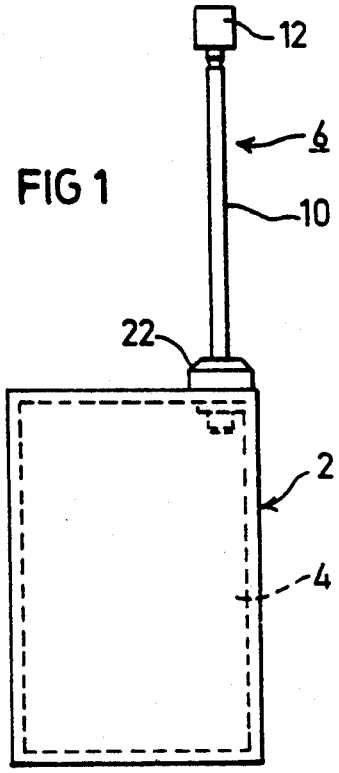
FIGS. 1 and 2 illustrate one form of electrical device constructed in accordance with the present invention, showing the extended and retracted positions, respectively, of the antenna.

The electrical device illustrated in the drawings is an electrical transmitter-receiver unit particularly useful in a cordless telephone in the CT2 system. It includes a housing, generally designated 2, enclosing the electrical circuitry, schematically indicated as 4, of the telephone transmitter-receiver, and an antenna assembly, generally designated 6, which is adaptable for either short-range or long-range use, according to the location of the user with respect to the nearest telepoint.

Figure 2:
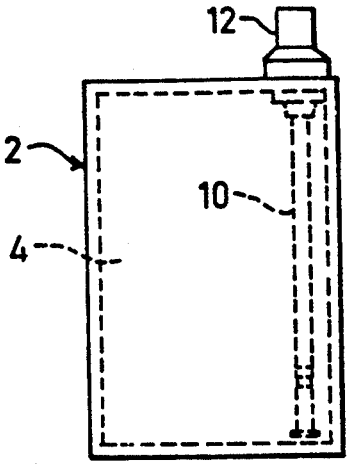
Figure 3:
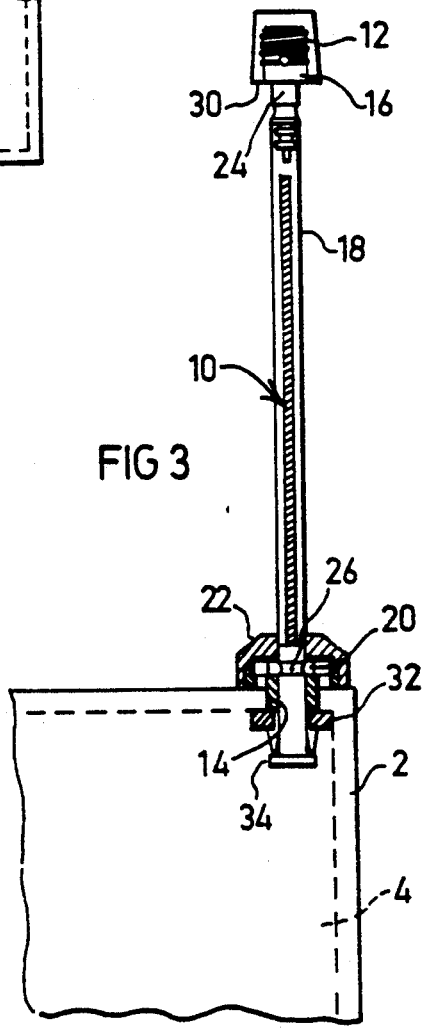
FIGS. 3 and 4 are fragmentary, sectional views, more particularly illustrating the internal construction of the antenna in its extended and retracted positions, respectively.
Figure 4:
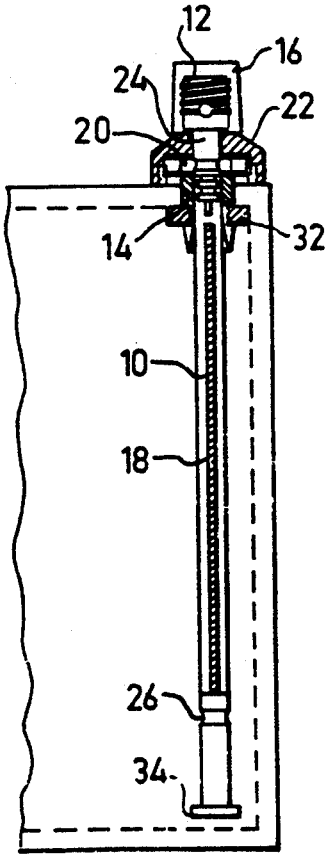

Antenna assembly 6 comprises a straight antenna rod 10 and an antenna coil 12 carried at the outer end of the antenna rod. The antenna rod 10 is movably mounted through an opening 14 in the top wall of housing 2 either to an extended position as illustrated in FIGS. 1 and 3, or to a retracted position as illustrated in FIGS. 2 and 4. When the antenna rod is in its retracted position (FIGS. 2 and 4), substantially only the antenna coil 12 is disposed externally of the housing 2; but when the antenna rod is moved to its extended position (FIGS. 1 and 3), substantially the complete antenna rod 10 and the antenna coil 12 are disposed externally of the housing.

Both the antenna rod 10 and the antenna coil 12 are of one-quarter wavelength pretuned to the same frequency. However, since antenna 12 is in coil form it is much more compact than antenna rod 10. Antenna coil 12 is embedded within a dielectric medium 16, whereas antenna rod 10 is enclosed within a dielectric sleeve 18. Antenna rod 10 may be a straight length of a stiff electrically-conductive rod, but preferably is of a stiff coiled configuration to enhance its flexibility without danger of breaking.

The illustrated device further includes electrical switching means effective, when the antenna rod 10 is in its retracted position (FIGS. 2, 4), to connect the antenna coil 12 to the electrical circuit 4, and thereby to condition the device for short range use. When the device is to be used for longer range, the antenna rod 10 is moved to its extended position, whereupon the electrical switching means connects the antenna rod to the electrical circuit 4.

As shown in FIGS. 3 and 4, the electrical switching means comprises an electrical connector in the form of a metal spring clip 20 fixed within a bushing 22 circumscribing opening 14 formed in the top wall of the housing 2. When the antenna assembly 6 is in its retracted position, as illustrated in FIGS. 2 and 4, the fixed connector 20 engages a movable electrical connector 24 located at the juncture of the antenna coil 12 with the antenna rod 10. When the antenna assembly 6 is in its extended position, as illustrated in FIGS. 1 and 3, the fixed electrical connector 20 engages a movable electrical connector 26 located at the end of antenna rod 10 opposite to that carrying the antenna coil 12.

The lower surface of antenna coil 12, particularly its dielectric casing 16, is flat to define a shoulder 30 engageable with the upper surface of bushing 22, and thereby to limit the retracted position of antenna assembly 10. Housing 2 further includes an apertured member 32 receiving the lower end of antenna rod 10, for guiding its movement within the housing 2, and also serving as a stop engageable with a shoulder 34 located at the lower end of the antenna rod for limiting it to its extended position.

The manner of using the device illustrated in the drawings will be apparent from the above description.

Thus, whenever the user is located relatively close to a telepoint, the antenna assembly 10 may be moved to its retracted position as illustrated in FIGS. 2 and 4, whereupon the fixed electrical connector 20 engages the movable electrical connector 24 to thereby connect the antenna coil 12 to the electrical circuit 4. This disables the antenna rod 10 and enables the antenna coil 12 for use in the relatively short range.

However, when the user is located relatively far from the nearest telepoint, antenna assembly 10 may be moved to its extended position, as illustrated in FIGS. 1 and 3, whereupon the fixed connector 20 engages movable connector 22 to connect the antenna rod 10 the electrical circuit 4. This disables the antenna coil 12 and enables the antenna rod for use.

While the invention has been described with respect to one preferred embodiment, it will be appreciated that many variations, modifications and other applications of the invention may be made.

What is claimed is:

1. An electrical device, comprising:

a housing enclosing electrical circuitry of the electrical device;

an antenna rod carried by said housing for use in long-range operation of the device and pretuned to a predetermined frequency;

an antenna coil carried by one end of said antenna rod for use in short-range operation of the device and pretuned to the same predetermined frequency;

said antenna rod being movably mounted through an opening in the housing to a retracted position wherein substantially only the antenna coil is disposed externally of the housing, or to an extended position wherein substantially the complete antenna rod and the antenna coil are disposed externally of the housing;

an electrical switching means effective when the antenna rod is in its retracted position to connect the antenna coil to said electrical circuit and thereby to condition the device for short-range operation, and when the antenna rod is in its extended position to connect the antenna rod to said electrical circuit, to disconnect the antenna coil therefrom, and thereby to condition the device for long-range operation.

2. The device according to claim 1, wherein said electrical switching means comprises:

a fixed electrical connector fixed to said housing;

a first movable electrical connector electrically-connected to said antenna coil and carried by said antenna rod so as to be engageable by said fixed electrical connector when the antenna rod is in its retracted position to connect the antenna coil to said electrical circuit;

and a second movable electrical connector connected to and carried by said antenna rod so as to be engageable by said fixed electrical connector when the antenna rod is in its extended position to connect the antenna rod to said electrical circuit.

3. The device according to claim 2, wherein said fixed electrical connector is located adjacent said opening in the housing through which the antenna rod is movable to its retracted and extended positions.

4. The device according to claim 3, wherein said first movable electrical connector is located at the juncture of the antenna coil with the antenna rod.

5. The device according to claim 4, wherein said second movable electrical connector is located at the end of the antenna rod opposite to that carrying the antenna coil.

6. The device according to claim 5, wherein said opposite end of the antenna rod carries a shoulder engageable with a stop fixed within the housing adjacent said opening for limiting the movement of the antenna rod when moved to its extended position.

7. The device according to claim 6, wherein said housing opening is circumscribed by an insulating bushing engageable with a stop carried by said antenna coil for limiting the movement of the antenna rod when moved to its retracted position.

8. The device according to claim 1, wherein said antenna rod and said antenna coil are both of quarter wavelength.

9. The device according to claim 1, wherein said antenna coil is embedded within a dielectric medium.

10. The device according to claim 1, wherein said antenna rod is enclosed within a dielectric sleeve.

11. The device according to claim 10, wherein said antenna rod is of a stiff coiled configuration.

12. An electrical transmitter-receiver, particularly useful in a CT2 cordless telephone comprising:

a housing enclosing electrical circuitry of the transmitter-receiver;

an antenna rod pretuned to a predetermined frequency carried by said housing;

an antenna coil pretuned to the same predetermined frequency carried by one end of said antenna rod;

said antenna rod being movably mounted through an opening in the housing to a retracted position wherein substantially only the antenna coil is disposed externally of the housing, or to an extended position wherein substantially the complete antenna rod and the antenna coil are disposed externally of the housing;

an electrical switching means effective when the antenna rod is in its retracted position to connect the antenna coil to said electrical circuit and to disconnect the antenna rod therefrom, and when the antenna rod is in its extended position to connect the antenna rod to said electrical circuit and to disconnect the antenna coil therefrom.

13. The transmitter-receiver according to claim 12, wherein said electrical switching means comprises:

a fixed electrical connector fixed to said housing;

a first movable electrical connector electrically-connected to said antenna coil and carried by said antenna rod so as to be engageable by said fixed electrical connector when the antenna rod is in its retracted position to connect the antenna coil to said electrical circuit;

and a second movable electrical connector connected to and carried by said antenna rod so as to be engageable by said fixed electrical connector when the antenna rod is in its extended position to connect the antenna rod to said electrical circuit.

14. The transmitter-receiver of claims 13, wherein said fixed electrical connector is located adjacent said opening in the housing through which the antenna rod is movable to its retracted and extended positions.

15. The transmitter-receiver of claim 14, wherein said first movable electrical connector is located at the juncture of the antenna coil with the antenna rod.

16. The transmitter-receiver of claim 15, wherein said second movable electrical connector is located at the end of the antenna rod opposite to that carrying the antenna coil.

17. The transmitter-receiver of claim 16, wherein said opposite end of the antenna rod carries a shoulder engageable with a stop fixed within the housing adjacent said opening for limiting the movement of the antenna rod when moved to its extended position.

18. The transmitter-receiver of claim 17, wherein said housing opening is circumscribed by an insulating bushing engageable with a stop carried by said antenna coil for limiting the movement of the antenna rod when moved to its retracted position.

19. The transmitter-receiver according to claim 12, wherein said antenna coil is embedded within a dielectric medium.

20. The transmitter-receiver of claim 12, wherein said antenna rod is of a stiff coiled configuration and is enclosed within a dielectric sleeve.

* * * * *